US006601359B2

(12) United States Patent
Olofsson

(10) Patent No.: US 6,601,359 B2
(45) Date of Patent: Aug. 5, 2003

(54) FLOORING PANEL OR WALL PANEL

(75) Inventor: Ola Olofsson, Trelleborg (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 09/878,252

(22) Filed: Jun. 12, 2001

(65) Prior Publication Data

US 2002/0100242 A1 Aug. 1, 2002

(30) Foreign Application Priority Data

Jan. 26, 2001 (DE) ..... 101 03 505

(51) Int. Cl.[7] ..... E04B 2/00
(52) U.S. Cl. ..... 52/588.1; 52/591.1; 52/592.1
(58) Field of Search ..... 52/589.1, 592.1, 52/590.2, 592.3, 588.1, 591.1, 591.3, 592.2

(56) References Cited

U.S. PATENT DOCUMENTS

| | | | |
|---|---|---|---|
| 2,004,193 | A | 6/1935 | Cherry |
| 2,740,167 | A | 4/1956 | Rowley |
| 3,479,784 | A | 11/1969 | Massagli |
| 3,535,844 | A | 10/1970 | Glaros |
| 3,553,919 | A | 1/1971 | Omholt |
| 3,720,027 | A | 3/1973 | Christensen |
| 3,798,111 | A | 3/1974 | Lane et al. |
| 3,807,113 | A | 4/1974 | Turner |
| 3,859,000 | A | 1/1975 | Webster |
| 3,921,312 | A | 11/1975 | Fuller |
| 4,426,820 | A | 1/1984 | Terbrack et al. |

(List continued on next page.)

FOREIGN PATENT DOCUMENTS

| | | |
|---|---|---|
| BE | 357844 | 3/1960 |
| BE | 1010487 | 12/1999 |
| CA | 991373 | 6/1976 |
| CA | 1169106 | 6/1984 |
| DE | 2159042 | 6/1973 |
| DE | 2238660 | 2/1974 |
| DE | 3343601 | 6/1985 |
| GB | 812671 | 4/1959 |
| GB | 1348272 | 3/1974 |
| GB | 1430423 | 3/1976 |
| GB | 2256023 | 11/1992 |
| JP | 3169967 | 7/1991 |
| SE | 501014 | 10/1994 |
| SE | 502994 | 9/1996 |
| WO | 9313280 | 7/1993 |
| WO | 9747834 | 12/1997 |
| WO | 9966151 | 12/1999 |
| WO | 0063510 | 10/2000 |

OTHER PUBLICATIONS

Pending U.S. application Ser. No. 09/672,077.
Pending U.S. application Ser. No. 09/988,014.
Pending U.S. application Ser. No. 09/770,395.
Pending U.S. application Ser. No. 10/158,945.
Pending U.S. application Ser. No. 09/672,076.

*Primary Examiner*—Carl D. Friedman
*Assistant Examiner*—Naoko Slack
(74) *Attorney, Agent, or Firm*—Stevens, Davis, Miller & Mosher, L.L.P.

(57) ABSTRACT

A flooring panel or wall panel (20) is provided with a tongue (1) and a groove (2) each comprising cooperating locking means in the form of ribs (11, 12) and grooves (9, 10). The locking means of the upper side and lower side of the tongue (1) and groove (2) respectively are arranged staggered in an insertion direction in which the two panels to be joined to each other are joined to configure a firm joint between two adjoining panels at which an additional surface portion (31; 32; 51) step (31) is provided at the surface area of the upper cheek (3) facing the groove (2) and/or of the lower cheek (5) of the groove which is formed as a step (31) or bevel (32: 51).

22 Claims, 2 Drawing Sheets

U.S. PATENT DOCUMENTS 4,449,346 A 5/1984 Tremblay
4,940,503 A 7/1990 Lindgren et al.
5,148,850 A 9/1992 Urbanick
5,216,861 A 6/1993 Meyerson
5,295,341 A 3/1994 Kajiwara
5,325,649 A 7/1994 Kajiwara
5,344,700 A 9/1994 McGath et al.
5,348,778 A 9/1994 Knipp et al.
5,502,939 A 4/1996 Zadok et al.
5,630,304 A 5/1997 Austin
5,706,621 A 1/1998 Pervan
5,797,237 A * 8/1998 Finkell, Jr. ..... 52/589.1
5,860,267 A 1/1999 Pervan
5,907,934 A 6/1999 Austin
6,006,486 A * 12/1999 Moriau et al. ..... 52/589.1
6,023,907 A 2/2000 Pervan
6,094,882 A 8/2000 Pervan
6,101,778 A 8/2000 Martensson
6,182,410 B1 2/2001 Pervan
6,205,639 B1 3/2001 Pervan
6,209,278 B1 4/2001 Tychsen
6,216,409 B1 * 4/2001 Roy et al. ..... 52/589.1
6,314,701 B1 11/2001 Meyerson
6,324,803 B1 12/2001 Pervan
6,385,936 B1 * 5/2002 Schneider ..... 52/589.1
6,397,547 B1 * 6/2002 Martensson ..... 52/582.1
6,418,683 B1 * 7/2002 Martensson et al. ..... 52/282.1
6,421,970 B1 7/2002 Martensson et al.
6,438,919 B1 * 8/2002 Knauseder ..... 52/586.2

* cited by examiner

FLOORING PANEL OR WALL PANEL

TECHNICAL FIELD

The invention relates to a flooring panel or wall panel as set forth in the preamble of claim 1.

In recent years laminated floor finishes have become increasingly popular in replacing parquet floors and wall-to-wall carpeting. In the production of laminated floor finishes a decorative thermosetting laminate is first produced. This laminate usually consists of a base layer of paper sheets, impregnated with phenol-formaldehyde resin, and a decorative surface layer comprising a decor paper sheet impregnated with melamine formaldehyde resin. The laminate is produced by compressing the various layers at a high pressure and an elevated temperature. The laminate thus obtained may then be bonded to a backing, for example of particle board, or used as such without a backing, it then be termed a compact laminate. The resulting laminated panel of large surface area is then sawn up into a number of floor boards each provided with tongues and grooves at their long and short sides. These floor boards may differ in thickness and size, they more particularly being square or rectangular. A popular length is 120 cm, and a popular with is approx. 20 cm. Such laminated floor finishes may also be used to top existing floor material.

In laying such a floor finish an adhesive cement is usually applied to the groove when the floor boards are assembled. This makes it difficult to replace a board when damaged or to remove the complete floor finish and, for example, reinstalling it in another room.

PRIOR ART

DE 42 42 530 A1 describes a building element for walls or building floors and roofing which comprises at its longitudinal edge a tongue-like element and the opposing longitudinal edge a groove-like molding. The tongue-like element is configured strongly rounded suitable for insertion by jiggling it into the groove-like opening. Provided on one side of the tongue-like element are two ribs suitable for snap-action jointing a single groove of an adjoining building element. As it reads from this disclosure, however, a certain clearance needs to remain, thus resulting in this building element not at all being suitable for floor or wall finishes which for a pleasing appearance need to be joined free of clearance and accordingly with no gaps.

A wall panel or flooring panel as it reads from the preamble of claim 1 is known from WO 96/27721 of the present applicant. The flooring panel described therein comprises a tongue cooperating with a groove in an adjoining panel, the tongue comprising at least one snap-action means in the form of a rib oriented parallel to the edge of the panel. Configured in the groove at suitable locations for cooperating with the ribs of the tongue is a retaining or snap-action groove. It is these snap-action means that enable two adjoining panels to be joined without needing to use an adhesive cement. The one panel with its tongue is inserted into the groove of the adjoining panel, the so-called cheeks defining the groove deforming at least temporarily to permit entry of the rib formed on the tongue and regaining their original shape as soon as each rib has snapped into the corresponding groove. Experience has shown that although such flooring or wall panels permit reliable joining and placement without requiring an adhesive cement there is room for improvement in facilitating laying and the strength in joining the panels to each other.

SUMMARY OF THE INVENTION

The invention is based on the object of providing a flooring panel or wall panel in which the snap-action or locking means are improved to facilitate laying and joining the panels whilst always attaining and maintaining a firm joint between adjoining panels.

This object is achieved by the flooring panel or wall panel as set forth in claim 1.

In accordance therewith the tongue of the panel in accordance with the invention too is provided with locking means. Provided at the opposite side of the panel is a groove into which the tongue of a panel is insertable when two adjoining panels are joined together. The tongue and the groove each comprise complementary snap-action or locking means. In this arrangement it is conceivable that both the tongue and the groove feature snap-action means in the form of ribs. The corresponding other element, i.e. either the tongue or the groove comprises a complementary snap-action means, i.e. a groove configured at a suitable location for each rib provided. As will be detailed later it is preferably within the scope of the invention that the tongue is provided with ribs. More particularly in a preferred embodiment ribs are configured on both the upper and lower side of the tongue, although it is just as conceivable to provide only one of these sides with a rib and the other side of the tongue with a groove. Likewise basically conceivable is to configure a groove on both the upper and lower side of the tongue.

In any case, however, both the upper and lower side of the tongue is provided with a locking means for a flooring panel or wall panel in accordance with the invention, locking means being provided correspondingly on the surface area defining the tongue both upper and lower. In accordance with the invention an additional surface portion formed as a step or bevel is provided on the surface area of the upper and/or lower cheek of the groove facing the groove. It is this aspect that facilitates producing the joint since when inserting the tongue, shifting it in the insertion direction requires little exertion force or may even require none at all. Insertion direction in this context is understood to be the direction in which the tongue is inserted into the groove to join two adjoining panels to each other. The insertion direction thus extends perpendicular to the edge as observed of the panel.

The advantage of the step or bevel in accordance with the invention is that it counteracts any undesirable tendency of the tongue to slip out of place on insertion. When joining the two panels the panel to be added new to the already existing flooring or wall section is first applied with the groove at an angle to the tongue of the desired jointing location and tilted downwards whilst simultaneously exerting pressure on the panel to be added in the insertion direction. Due to the angled surfaces of the tongue and of the surfaces of the groove shaped angled thereto it may often occur that the tongue slips out of place from the groove because of insufficient force being exterted in the insertion direction. This is prevented by a step or bevel in accordance with the invention on one or both cheeks of the grooves since this prevents the tongue from slipping out of place from the groove contrary to the insertion direction either due to a positive connection with the tongue or facilitates the movement of the tongue in the insertion direction into the groove by providing a surface inclined inwards. When bevels widening the groove are provided on one or both cheeks of the groove in the insertion direction it is now possible to join the panels without needing to apply any pressure at all in the insertion direction, i.e. simply jiggling the panel to be joined to an already existing flooring or wall section may be sufficient so that by the effect of the bevel(s) the tongue will always work its way into the groove until the snap-action means is activated.

Preferred further embodiments of the panel in accordance with the invention read from the sub-claims.

Although a panel in accordance with the invention is conceivable in the form of a triangle with a groove or tongue configured on each side, the panel in accordance with the invention preferably has four sides and is more particularly rectangular or square. In this case two sides of the panel comprise tongues and two sides of the panel comprise grooves. It is understood that, as preferred, the panels may be configured identical and can be joined to each other in this way when the opposite side in each case is provided tongued and grooved so that two adjoining sides, in the case of a rectangular panel a short and a long side, are provided with tongues, and the two other sides with the complementary configured grooves.

As already mentioned it is preferred in accordance with the invention that the tongue comprises as a locking means at least one protuberance, more particularly a rib and that the locking means cooperating therewith in the groove are recesses, more particularly snap-action or locking grooves.

In accordance with one preferred embodiment of the invention the snap-action means are arranged staggered in the insertion direction. Staggering in the insertion direction means that one of the locking means is configured more distant from the edge of the panel than the other, in other words one of the locking means extends parallel to the edge of the panel at a greater distance away from this edge than the other locking means.

The advantage of a firm joint is likewise achieved with the preferred embodiment in which the tongue comprises at the upper side a protuberance, preferably a rib and at the lower side two protuberances or ribs, and the groove is provided with corresponding snap-action grooves.

Tests show that configuring the locking contours in accordance with the invention facilitates laying the flooring panels, more particularly in facilitating joining two adjoining flooring panels, it also having been found out that the joint thus resulting between two adjoining panels is extremely firm. The reason for this could be that due to the stagger, any movement of the two flooring panels joined together relative to each other is made difficult. When the locking means of both sides are located precisely opposite each other, tilting the two flooring panels is easier possible when the locking means are staggered relative to each other and any movement "about" the one locking element by the other locking element is obstructed.

Preferably the additional surface portion is a bevel, the inclination of which is configured so that the groove is flared portionwise in the insertion direction. This arrangement promotes the tendency of the tongue to slip into the groove or to automatically "work" its way it groove when the two panels to be joined together are jiggled.

Experience has shown it to be particularly of advantage to configure the inclination of the bevel(s) in the range 50° to 20° to the upper surface area of the panel and thus when laying the panels on a flat floor surface area the bevels are inclined at an angle in the range 5° to 20° to the horizontal.

Damage to the cheeks defining the groove can be prevented when their edges end substantially at the same location, i.e. when in other words the edge of the upper cheek of the groove or lip is arranged substantially exactly over the edge of the lower cheek of the groove or lip.

It is good practice to configure the locking contours which are particularly prone to damage, so that the recess or groove in the lower cheek of the groove or lip is arranged at a location which is totally distal within the distal edge of the upper lip or cheek of the groove.

In certain applications, however, the lower cheek of the groove or lip preferably protrudes distally beyond the distal edge of the upper cheek of the groove or lip.

However, in this case too, it is good practice when the recess or groove in the lower cheek of the groove or lip is provided at a location totally, or at least substantially, within the distal edge of the upper lip or cheek of the groove.

Another preferred embodiment which experience has shown to be of advantage as regards the strength of the joint consists of the edge of the upper cheek of the groove being located substantially precisely above the edge of the lower cheek of the groove, the tongue being provided at both its upper side and lower side with a protuberance and the recess in the lower cheek of the groove being provided at a location which is totally within the distal edge of the upper cheek of the groove.

In the same way another embodiment is of advantage in which the edge of the lower cheek of the groove protrudes distally beyond the distal edge of the upper cheek of the groove, the tongue being provided on both its upper and lower side with a protuberance and the recess being provided in the lower cheek of the groove at a location which is totally, or at least partly, on the other side of the distal edge of the upper cheek of the groove.

As an alternative a firm joint is also obtainable—in the same case as described above—by providing the recess in the lower cheek of the groove at a location which is totally, or substantially totally, within the distal edge of the upper cheek of the groove.

For the materials of the flooring panel a structure comprising a base layer of particle board, medium or high density fiber board or plastics topped by a decor finish of paint or a thermoplastics, veneer or one or more sheets of paper impregnated with a thermosetting resin or laminate is of particular advantage.

For particularly cost-effective production of the panel in accordance with the invention it is good practice to configure the tongue and the groove as well as the snap-action means integrally with the base layer, in other words to mill the locking contours from the base layer.

When used in wet rooms it is good practice to configure the side edges comprising the tongue and groove water-tight.

For this purpose it is good practice to treat the base layer of the panel in accordance with the invention such that its resistance to water is enhanced.

More particularly, good performance of this embodiment is achievable by impregnating or coating the complete base layer or at least the side edges of the panel with a wax, an oil or a resin.

For a simple joint of two adjoining panels it is good practice to configure a front surface area of the tongue with its lower side tapered which may also be provided supplementary for the upper edge of the tongue.

One particularly advantageous feature applicable to the flooring panel or wall panel in accordance with the invention consists of the lower cheek of the groove being thinner than its upper cheek so that the lower cheek is more pliant than the upper cheek and is deformed to a greater extent than the upper cheek of the groove when joining two adjoining panels. Preferably the upper cheek of the groove should not deform at all to eliminate the risk of steps forming when joining the panels together. Instead only the lower cheek of the groove should slightly deform on joining before snapping back into place for a secure lock. The comparitively thick and thus comparatively stiff upper cheek of the groove or lip also contributes towards maintaining the floor surface area flat once the panels have been joined and when accessed.

In conclusion it has found to be particularly of advantage in this case to configure the lower lip or cheek of the groove 50% to 90%, preferably 60% to 85% as thick as the upper cheek of the groove.

BRIEF DESCRIPTION OF THE DRAWINGS

Embodiments of the invention will now be detained by way of example with reference to the drawings in which.

DETAILED DESCRIPTION OF PREFERRED EMBODIMENTS OF THE INVENTION

Figure 1:
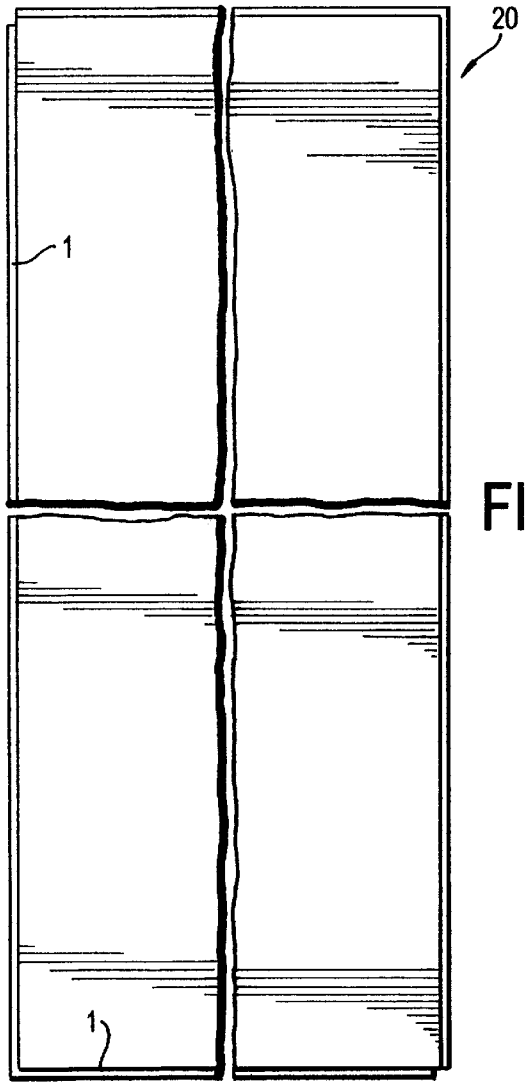
FIG. 1 is a plan view of the flooring panel or wall panel in accordance with the invention.
Figure 5:
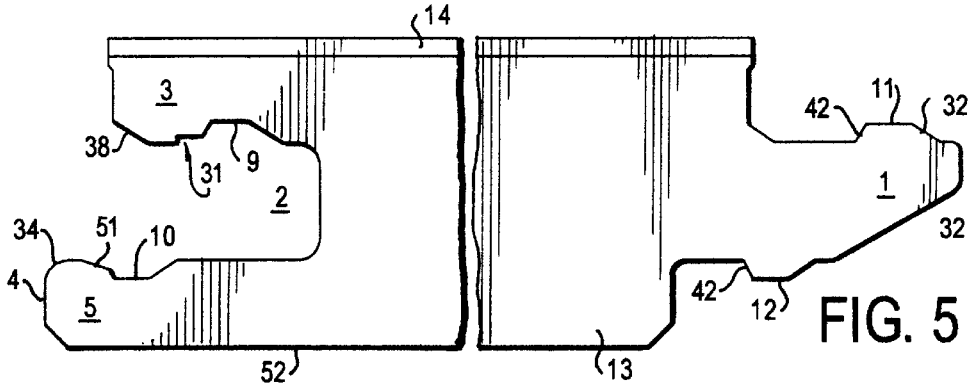
FIG. 5 is a sectioned view through the flooring panel or wall panel in accordance with the invention in a fourth embodiment.

Referring now to FIG. 1 there is illustrated a plan view of the flooring panel or wall panel in accordance with the invention in which it is to be noted that to simplify the illustration only a few corner portions of the panel 20 are shown and that the panel may be dimensioned optionally between these corner portions as shown, it more particularly being shaped either square or rectangular. Configured at the (longer) longitudinal edges of the embodiment of the panel 20 as shown is on the one side (on the left in FIG. 1) a tongue 1 and on the opposite side a groove. Likewise on the lower short side as shown in FIG. 1 a tongue 1 is configured with a groove provided on the opposite short side. It is obvious that due to this configuration panels of the same kind can be joined together to form a complete floor finish. It is to be noted that the tongue 1 and the locking means as to be later described are configured continuous and full-length in each of the preferred embodiments, although it is just as conceivable to configure both the tongue 1 and the locking means discontinuous. In conclusion it is to be noted as regards FIG. 1 that it shows a plan view of a preferred embodiment in which—as evident from FIG. 2 for example—the lower cheek of the groove protrudes beyond the edge of the upper cheek of the groove, this being the reason why two lines are evident at the top right-hand edge of the illustration in FIG. 1, although, of course, only one line would be present for example in the case of the embodiment as shown in FIG. 5 since in this case the two cheeks of the groove end substantially at the same level.

Figure 2:
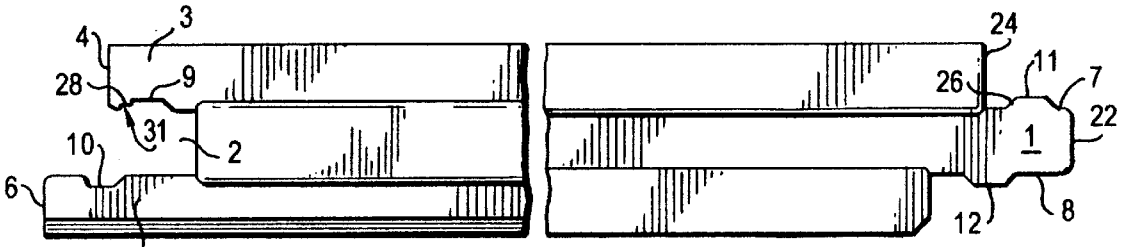
FIG. 2 is a sectioned view through the flooring panel or wall panel in accordance with the invention in a first embodiment.

Referring now to FIG. 2 there is illustrated an embodiment of the locking means of the flooring or wall panel 20 in accordance with the invention. For one thing, the protruding tongue 1 comprises at both its upper side and lower side a protuberance or rib 11 and 12 respectively. The two ribs are configured staggered, i.e. differingly spaced away from the edge 22 of the tongue 1. For locking to a panel of the same kind a groove 2 is configured in the opposite side defined by two cheeks or lips 3 and 5 respectively. Snap-action grooves 9 and 10 respectively are provided in each of the two lips 3, 5. The position of these snap-action or locking grooves 9, 10 is complementary to the position of the ribs 11 and 12 on the upper side 7 and lower side 8 of the tongue 1 to thus enable two panels of the same kind to be locked together. The locking action results from, for example, the spacing between the edge 24 of the panel 20 above the tongue 1 and the rear flank 26 of the rib 11 being slightly smaller than the spacing between the front edge 4 of the upper cheek 3 of the groove and the front flank 28 of the locking groove 9. Likewise the relationships for the lower rib and the corresponding groove may be set such that, here too, a firm snap-action joint materializes to lock two adjoining panels to each other.

In addition a step 31 is indicated on the surface area of the upper cheek 3 facing the groove 2 to facilitate in accordance with the invention joining the panels and which will be later detailed with reference to the subsequent FIGS. 4 to 7.

The contour as described is configured preferably on all opposite sides, i.e. on each longitudinal side and short side to ensure locking at all edges. For this purpose the tongue 1 on each panel 20 is inserted into the groove of an adjoining panel until the ribs 11, 12 snap into place in the grooves 9, 10. More particularly a firm joint, in which also any tendency of the two adjoining panels to tilt is effectively prevented, is achieved in that to a certain extent to the front of the rear lock in the form of the rib 12 and groove 10 a further lock in the form of the rib 11 in the groove 9 is provided which enhances stability, especially in preventing tilting.

Figure 3:
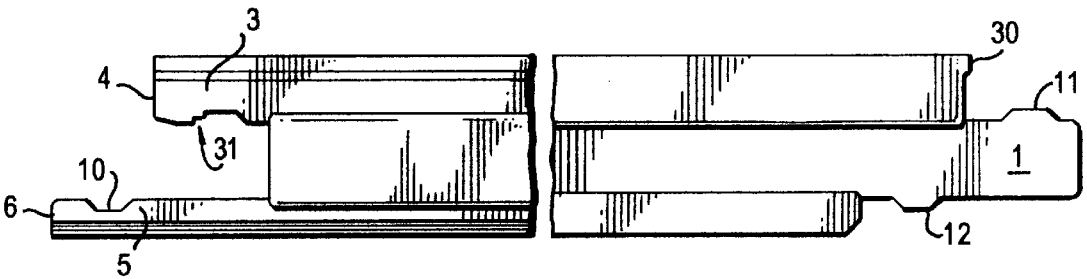
FIG. 3 is a sectioned view through the flooring panel or wall panel in accordance with the invention in a second embodiment.

Referring now to FIG. 3 there is illustrated the same as in the embodiment as shown in FIG. 2 how a rib 11 and 12 respectively is provided on the upper and lower side of the tongue 1, here, however, more staggered than in the embodiment as shown in FIG. 2 so that the snap-action groove 10 configured in the lower cheek 5 of the groove is located totally on the other side of the front edge 4 of the upper cheek 3 of the groove. This configuration makes for a particularly long leverage in locking two adjoining panels together to thus achieve a joint safe from tilting.

The embodiment as shown in FIG. 3 further indicates how the lower cheek 5 of the groove is significantly thinner than the upper cheek 3 thereof so that when locking two panels together it is substantially only the lower cheek 5 that is deformed with no risk of the upper cheek 3 being deformed. This additionally ensures a stable surface of the floor finish when layed. It is further to be understood as regards locking the two adjoining panels together that when inserting the tongue 1 the lower and, where necessary, also the upper cheek of the groove need to give to make room for the "extra-thick" ribs 11, 12. Once the ribs 11, 12 are located in the corresponding grooves 9, 10 the lower and/or upper cheek of the groove return to their original position. In the embodiment as shown in FIG. 3 there is a further special feature provided in that a small protuberance or a nose 30 is configured on the panel above the tongue 1 to ensure a defined contact of the upper edge of the panel 20 with the upper edge of an adjoining panel to thus effectively prevent gaps forming whilst achieving a particularly rugged joint. It is to be noted that the nose 30 may be provided alternatively or additionally at the front edge 4 on the groove side.

Figure 4:
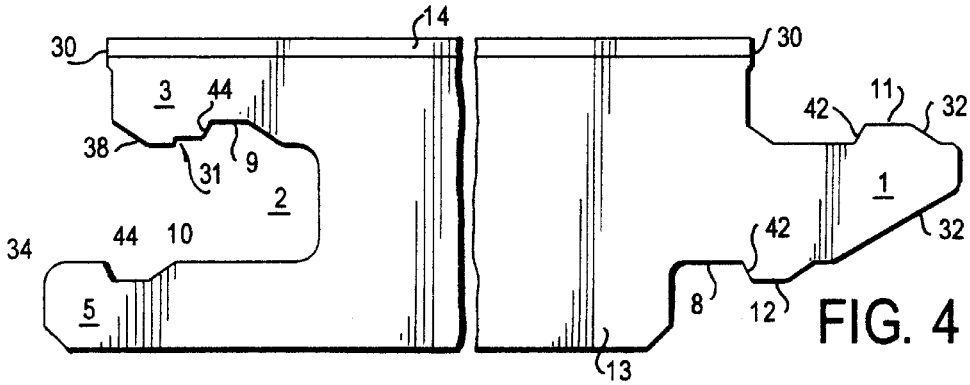
FIG. 4 is a sectioned view through the flooring panel or wall panel in accordance with the invention in a third embodiment.

Referring now to FIG. 4 there is illustrated an embodiment which is the same as that shown in FIG. 2 to a major extent, except that here the lower side 8 of the tongue 1 is provided in the front portion with a bevel 32 to facilitate inserting the tongue 1 into the groove 2. Due to the rounding 34 of each inner edge of the upper cheek 3 and lower cheek 5 of the groove two panels to be joined can be more easily jiggled to facilitate dismantling the panels. Further provided at the inner edge of the upper cheek 3 of the groove is a bevel 38 which has the same effect as the rounding 34 of the lower cheek 5 of the groove, this more particularly facilitating inserting the tongue 1 into the groove 2 and dismantling two panels joined to each other. This is also promoted by the fact that the tongue 1 is provided with a bevel 32 not only at its lower side 8 but also by its upper side 7 featuring a somewhat less steeper bevel 32. A particularly firm joint and defined contact of the two panels with each other is achieved in that a nose 30 is provided on both the groove side and the tongue side. In conclusion the flanks too of the ribs 11 and 12 are bevelled. More particularly the front flanks are provided with a comparatively fiat bevel 32 to facilitate their insertion into the grooves 9 and 10 respectively. The bevel at the rear flank is configured as the somewhat steeper bevel 42 and may be more particularly complementary to a corresponding bevel 44 at the front flank of the corresponding grooves 9, 10. As evident from FIG. 4 the locking means in the form of ribs and grooves are likewise staggered in this case which is advantage for a firm joint.

In the embodiment as shown in FIG. 4 a step 31 is provided at the surface area of the upper cheek 3 of the groove facing the groove. This step serves to cooperate with the tongue and more particularly to cooperate with the bevel 42 of the rib 11 when jiggling the tongue of a panel to be joined. It is due to the step 31 and contact of the rib 11 of a further panel to be joined that the tongue 1 of the latter is prevented from slipping out of contact with the groove 2 when jiggled.

Since the step 31 represents a recess and since the cheeks of the groove snap back into their original position after having been elastically deformed, a spacing remains which is not filled out by the tongue and groove in the region of the step 31 in the assembled condition, resulting in tongue and groove not being in contact with each other in the assembled condition.

Referring now to FIG. 5 there is illustrated a further embodiment of the invention in which in addition to the step 31 on the upper cheek 3 of the groove a bevel 51 is provided on the front edge 4 inclined downwards in the direction of insertion, in other words the surface of the lower cheek 5 of the groove facing the groove 2 inclined approaches the lower side 52 of the panel with increasing spacing from the distal edge 4. The friction between the inner edge of the lower snap-action rib 12 of the tongue 1 and the bevel 51 additionally prevents the tongue from slipping out of the groove and promotes the movement of the tongue inwards when jiggling the panel to be joined.

Figure 6:
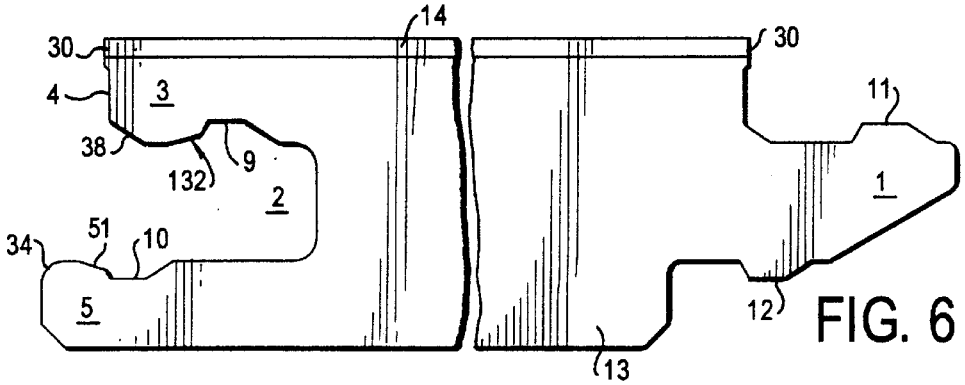
FIG. 6 is a sectioned view through the flooring panel or wall panel in accordance with the invention in a fifth embodiment.

Referring now to FIG. 6, there is illustrated an embodiment which differs from tat as shown in FIG. 5 in that step 21 on the upper cheek 3 of the groove has been replaced by a second bevel 132. This bevel 132 is oriented so that with increasing spacing from the distal edge 4 of the upper cheek 3 of the groove the bevel 132 approaches the surface 14. The same in the embodiments shown in FIGS. 4 and 5 the correspondingly shaped tongue 1 has no surface portion shaped corresponding to the bevels 132 and 51 and thus in the fully latched condition of the tongue 1 in the groove 2 a spacing remains in the portion of the bevel 132 as well as of bevel 51 at which the tongue is not snugly in contact with the sides of the cheeks facing the groove. In the embodiment shown in FIG. 6 too, the bevels result in preventing the tongue from slipping out contrary to the insertion direction by friction with the ribs 11 and 12 of a tongue and to move a panel to be joined in the insertion direction with jiggling in working it into the snap-action grooves 9 and 10.

Figure 7:
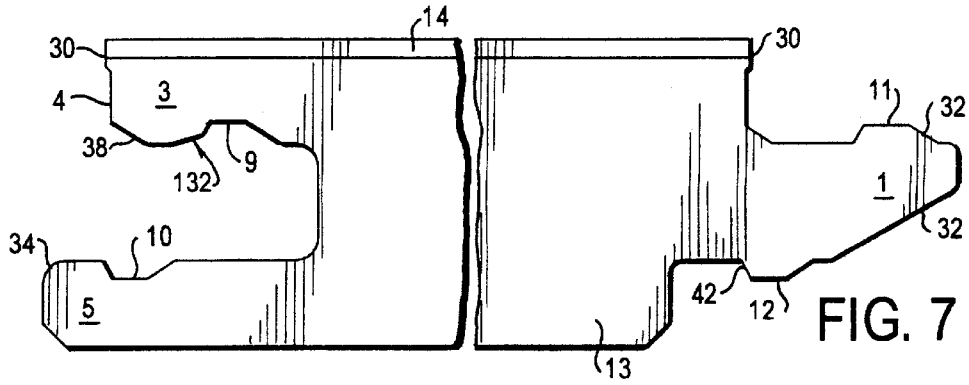
FIG. 7 is a sectioned view through the flooring panel or wall panel in accordance with the invention in a sixth embodiment.

Referring now to FIG. 7 there is illustrated yet another embodiment which is like that as shown in FIG. 4 but in which only the upper cheek 3 if the groove is provided with a bevel 132 in the portion between the snap-in groove 9 and the distal edge 4 of the cheek. The inclination of the surface area corresponds to that of the bevel 132 in the embodiment shown in FIG. 6.

In all embodiments having bevels the inclination may be in the range of 50° to 20° relative to the surface 14.

In the embodiments as described above a surface portion is provided in each case in which one or both cheeks of the groove is/are not shaped in accordance with the geometry of the corresponding tongue, they instead feature a step 31 or a bevel 132 or 51 respectively. The surface portion(s) is/are arranged in the portion between the snap-action grooves 9, 11 preferably arranged staggered in the upper cheek 3 and lower cheek 5 of the groove. It is especially in the case of the embodiment as shown in FIG. 6 that by providing a bevel at each cheek of the groove assembling the flooring panels or wall panels is greatly facilitated by very simple ways and means since when fining a further panel to the already assembled area the joint can be made by jiggling the panel to be newly joined to thus work the tongue by the cooperation of the bevels 132 and 51 into the groove until the ribs 11 and 12 latch into place in the snap-action grooves 9 and 10.

It is further to be noted as regards the FIGS. 4 to 7 that the preferred configuration of the panel 20 in accordance with the invention is particularly well evident. Integrally configured in a base layer 13 are the locking contours in the form of the tongue 1 and groove 2, it being on the base layer 13 that a decorative surface 14 is applied for which the materials as cited above may be selected.

What is claimed is:

1. A flooring panel or wall panel having at least three side edges provided with a locking means in the form of a tongue and/or a groove, said groove comprising an upper cheek adjoiningly arranged above and at the upper side of said groove and ending at a distal edge of said upper cheek of the groove and a lower cheek adjoiningly arranged below and at the lower side of said groove and ending at a distal edge of said lower cheek of said groove, said tongue comprising an upper side and a lower side, the surface area of said upper cheek and of said lower cheek each facing said groove being provided with at least one snap-action means and said upper side and lower side of said tongue being provided with at least one complementary snap-action means, said snap-action means comprising a protuberance forming a snap-action rib and a recess forming a snap-action groove, wherein an additional surface portion is provided at the surface area of said upper cheek and/or said lower cheek facing said groove formed as a step or bevel, wherein said upper cheek is provided with a step or an inwards, inclined surface proximal with respect to a bevel at a distal edge of the upper cheek.

2. The panel as set forth in claim 1, wherein said panel has four sides, two of which comprise tongues and the other two comprise grooves.

3. The panel as set forth in claim 1, wherein said snap-action means at said tongue consist of protuberances and said snap-action means cooperating therewith consist of recesses at said cheeks of said groove.

4. The panel as set forth in claim 3, wherein said edge of said lower cheek of said groove extends distally beyond said edge of said upper cheek of said groove, said tongue being provided with a protuberance at its upper side and a protuberance at its lower side and said recess in said lower cheek of said groove is arranged at a location which is totally or substantially totally within said distal edge of said upper cheek of said groove.

5. The panel as set forth in claim 1, wherein relative to an insertion direction in which two panels of the same kind are joined said snap-action means are staggered relative to each other and configured such that they force adjoining panels to form a tight joint when said tongues snap into place in said grooves.

6. The panel as set forth in claim 1, wherein an additional surface portion is provided only at said upper cheek of said groove.

7. The panel as set forth in claim 1, wherein an additional surface portion is provided on both said upper cheek and said lower cheek of said groove.

8. The panel as set forth in claim 1, wherein at least one additional surface portion is a bevel, the inclination of which is oriented so that with increasing spacing from said distal edge of the corresponding cheek of said groove said bevel is distanced from a plane as defined by a centerplane between the upper and lower side of said panel.

9. The panel as set forth in claim 8, wherein said inclination of said bevel(s) to said upper side surface area of said panel is in the range of 5° to 20°.

10. The panel as set forth in claim 1, wherein said edge of said upper cheek of said groove is arranged precisely or substantially straight above said edge of said lower cheek of said groove.

11. The panel as set forth in claim 10, wherein said recess in said lower cheek of said groove is arranged at a location which is distal within said distal edge of said upper cheek of said groove.

12. The panel as set forth in claim 1, wherein said lower cheek of said groove extends distally beyond said distal edge of said upper cheek of said groove.

13. The panel as set forth in claim 12, wherein said recess in said lower cheek of said groove is arranged at a location which is totally or at least substantially within said distal edge of said upper cheek of said groove.

14. The panel as set forth in claim 1, wherein said panel comprises a base layer of particle board, medium or high density fiber board or plastics topped by a decor finish of pain or a thermoplastics, veneer or one or more layers of paper impregnated with a thermosetting resin or laminate.

15. The panel as set forth in claim 14, wherein the side edges of said groove and tongue are water-tight.

16. The panel as set forth in claim 15, wherein said base layer is treated such that said water-tightness is enhanced.

17. The panel as set forth in claim 16, wherein said complete base layer or only said side edges of said panel are impregnated or coated with a wax, an oil or a resin.

18. The panel as set forth in claim 1, wherein said tongue and said groove as well as said snap-action means are configured integrally with said base layer.

19. The panel as set forth in claim 1, where said tongue comprises a beveled lower front surface area.

20. The panel as set forth in claim 1, wherein said lower cheek is thinner than said upper cheek of said groove.

21. The panel 28 set forth in claim 20, wherein the thickness of said lower cheek is 50% to 90%, preferably 60% to 85%, of the thickness of said upper cheek of said groove.

22. The panel as set forth in claim 1, wherein the lower cheek comprises an inward inclining surface.

* * * * *